US006305689B1

(12) United States Patent
Webb

(10) Patent No.: US 6,305,689 B1
(45) **Date of Patent: *Oct. 23, 2001**

(54) METHOD AND APPARATUS FOR PLAYING A REVERSE BLACKJACK CARD GAME

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/318,798

(22) Filed: May 26, 1999

(51) Int. Cl.[7] ..... A63F 1/00
(52) U.S. Cl. ..... 273/292; 273/274; 463/12
(58) Field of Search ..... 273/292, 274; 463/12

(56) References Cited

U.S. PATENT DOCUMENTS 5,673,917 10/1997 Vancura .

OTHER PUBLICATIONS

Scarne's Encyclopedia of games , chapter 16 , pp. 276–290), 1973.*
Reverse Baccarat from Casino Game Design (pp. 1–17), 1995.*

* cited by examiner

*Primary Examiner*—Benjamin H. Layno
*Assistant Examiner*—Vishu K Mendiratta
(74) *Attorney, Agent, or Firm*—Nixon & Vanderhye P.C.

(57) ABSTRACT

A Blackjack derivative card game incorporates a reverse play methodology, wherein after dealing hands of cards to a player and to a dealer, the dealer's hand is resolved in accordance with predetermined game rules prior to resolving the player's hand. If the dealer is still in the game after resolving the dealer's hand, the player's hand is then resolved in accordance with the rules. With this methodology, disadvantages associated with conventional game play such as Blackjack can be eliminated. For example, with the dealer hand exposed and resolved, the players are not required and do not perceive a requirement to understand a basic strategy. Rather, the goal is simply to beat the dealer's hand. The impact of card counting can also be eliminated, and the speed of game play can be increased.

41 Claims, 2 Drawing Sheets

METHOD AND APPARATUS FOR PLAYING A REVERSE BLACKJACK CARD GAME

BACKGROUND OF THE INVENTION

The present invention relates to card games and, more particularly, to Blackjack variant card games.

With the expansion of gaming and the increase in competition, casinos are striving to offer a wider variety of games. Growth in slot machine popularity and the increase in variety of specialty games has resulted in the overall reduction in conventional Blackjack ("21") tables.

Many casinos, however. are reluctant to reduce the number of Blackjack tables because of the inherent game attractiveness to both players and casinos. The game is based on simple concepts and procedures that are readily understood by both casual and regular players. Moreover, the game requires relatively low overhead to facilitate and monitor. In addition, floor space is limited in a casino, and casino operators are reluctant to replace an income-generating Blackjack table with a new game variety.

In conventional Blackjack, however, experienced players can utilize established strategies to practically eliminate the house advantage. The ability to eliminate the house advantage is obviously a concern for casino operators. Additionally, less experienced or beginning players may be hesitant to play Blackjack because they are aware that such strategies exist, but are unable to execute them themselves. Novice players play poorly even with some knowledge of the basic strategy and therefore have a more negative experience than might otherwise have been the case. Still further, with conventional Blackjack, these established strategies can be enhanced to actually achieve a player advantage when coupled with the use of card counting. Although discouraged in most casinos, it is difficult to police card counting as a rehearsed card counter can typically count cards without exhibiting any outward appearance of counting.

Still further, disputes between the players can arise when novice players are seated with experienced players. That is, a novice player may instruct the dealer to deal an additional card or instruct the dealer not to deal an additional card when the experienced player believes the contrary was appropriate. Often, the experience player perceives that the novices improper instruction resulted in an adverse outcome.

Another drawback associated with conventional Blackjack is that the dealer is instructed to deal a player's hand through particular gestures by the player. It is possible that these gestures may intimidate novice players. Moreover, if a dealer misinterprets a particular gesture, a likely dispute must be resolved.

In an attempt to accommodate the desire for variety and the retention of a significant Blackjack presence, several Blackjack variant games have been introduced. These games include Multiple Action Blackjack, Spanish 21, Face-Up 21, and Royal Match. See. e.g.. U.S. Pat. No. 5,673,917 to Vancura. A summary of known Blackjack variants is discussed in the Vancura patent. Spanish 21, however, seems to be the only Blackjack variant that has endeavored to address the primary problems of Blackjack. In Spanish 21, the cards with a value of 10 are removed from the regular deck. As the 10 cards are valuable for a card counter, Spanish 21 is less attractive to the card counter. The removal of 10's alone increases the house advantage too high, so additional play options and bonus pays are incorporated to give a better balanced house advantage. However, there is still a best basic strategy for Spanish 21, which the majority of players are probably unaware is quite different from regular basic strategy. Thus, while the game is an enjoyable variant and has achieved some popularity, many players will have had a substantively more negative experience than at regular Blackjack.

SUMMARY OF THE INVENTION

According to the present invention, a "reverse" Blackjack derivative provides a game that eliminates the experienced players' ability to significantly reduce house advantage using an established strategy. The game also eliminates the potential impact of card counting. Moreover, by virtue of the method and apparatus according to the invention, novice players play the game correctly and are thus not intimidated, player disputes are eliminated amongst each other as well as versus the dealer; thus, the adversarial nature of the game is removed, and casino operators need not replace an existing Blackjack table.

According to the present invention, the game of reverse Blackjack, so called JackBlack,™ is played on Blackjack-shaped table with dealer and cards similar to a Blackjack game. Similar to conventional Blackjack, each player receives two cards and the dealer receives two cards. Unlike regular Blackjack, however, both the dealer cards rather than only one, are exposed, and the dealer hand is completed first. If the dealer is still in the game after resolving the dealer hand, the players then play out their hands until either tying or beating the dealer or exceeding an upper limit.

This reverse play methodology has a dramatic impact on the dynamics of Blackjack. Because there is no skill element, the house advantage must be set higher than for regular Blackjack. This is because the majority of Blackjack players play at less than optimum strategy, whereas at JackBlack™ according to the invention, everybody plays a correct strategy. The use of a higher basic house advantage deters skilled players from playing JackBlack™.

Operationally, there are significant advantages resulting from the method and apparatus according to the invention. First, the player cannot make an error, as the dealer deals and totals all cards without a player having to request cards. Second, a player does not need to memorize or use hand signals to the dealer in order to indicate whether requesting an additional card or standing with the current hand. Third, disputes between the dealer and player over a misunderstanding of hand signals are eliminated. Fourth, disputes between player and player over whether a player was correct or not to make a certain play are eliminated. Fifth, the supervisors do not have to spend time following the play pattern of higher-stakes players to determine if the player is using advanced skill techniques such as card counting or shuffle tracking.

Still further, there are additional advantages from a casino operator point of view. That is, there is no downtime where a player deliberates about whether to draw a card or not, thus improving the speed of play. Moreover, when the dealer hand exceeds an upper limit (bust), there has been no time spent on improving or busting player hands and no associated depletion of the cards remaining. Similarly, when the dealer busts, all hands push (tie), so there was no requirement to take or pay wagers. Additionally, when the dealer is still in the game after resolving the dealer hand. each player draws cards automatically until tying, winning or exceeding the upper limit, resulting in a procedure where busted hands are removed and wagers taken. tied hands are removed and wagers stand, and players remaining with cards win, enabling all payoffs to be made at the same time.

These and other features and advantages of the present invention are achieved by providing a method of playing a card game including:

(a) dealing hands of cards to a player and to a dealer;

(b) determining a numerical total of the dealer's hand, wherein:

(b1) if the numerical total of the dealer's hand is below a lower limit, dealing an additional card to the dealer and repeating step (b), (b2) if the numerical total of the dealer's hand is equal to or greater than the lower limit without exceeding an upper limit, proceeding to step (c), and (b3) if the numerical total of the dealer's hand exceeds the upper limit, discarding the dealer's hand and skipping steps (c) and (c1)–(c4); and (c) determining a numerical total of the player's hand, wherein:

(c1) if the numerical total of the player's hand is below the numerical total of the dealer's hand. dealing an additional card to the player and repeating step (c), (c2) if the numerical total of the player's hand is equal to the numerical total of the dealer's hand, declaring the game outcome in accordance with predetermined rules of the game, (c3) if the numerical total of the player's hand is above the numerical total of the dealer's hand without exceeding the upper limit, the player winning the game, and (c4) if the numerical total of the player's hand exceeds the upper limit, the dealer winning the game.

In accordance with another aspect of the invention, a method of playing a card game is provided including the steps of dealing hands of cards to a player and to a dealer, resolving the dealer's hand in accordance with predetermined game rules prior to resolving the player's hand, and if the dealer is still in the game after resolving the dealer's hand. resolving the player's hand in accordance with the predetermined game rules.

In accordance with yet another aspect of the invention, there is provided an apparatus configured for playing a card game comprising a display, a player interface for receiving player input. and circuitry for effecting game play and comprising:

means for dealing hands of cards to a player and to a dealer;

a summing circuit that determines a numerical total of the dealer's hand;

a processing circuit effecting game play based on the numerical total of the dealer's hand such that:

(a) if the numerical total of the dealer's hand is below a lower limit, the dealing means dealing an additional card to the dealer and re-determining the numerical total of the dealer's hand, (b) if the numerical total of the dealer's hand is equal to or greater than the lower limit without exceeding an upper limit, continuing the game play, and (c) if the numerical total of the dealer's hand exceeds the upper limit, discarding the dealer's hand and restarting the game play;

wherein the summing circuit further determines a numerical total of the player's hand, wherein the processing circuit further effects game play based on the numerical total of the player's hand such that:

(d) if the numerical total of the player's hand is below the numerical total of the dealer's hand, the dealing means dealing an additional card to the player and re-determining the numerical total of the player's hand, (e) if the numerical total of the player's hand is equal to the numerical total of the dealer's hand, declaring the game outcome in accordance with predetermined rules of the game.

(f) if the numerical total of the player's hand is above the numerical total of the dealer's hand without exceeding the upper limit, the player winning the game, and (g) if the numerical total of the player's hand exceeds the upper limit, the dealer winning the game.

In accordance with still another aspect of the invention, there is provided an apparatus configured for playing a card game comprising a display, a player interface for receiving player input, and circuitry for effecting game play including structure for dealing hands of cards to a player and to a dealer, and structure for resolving the dealer's hand in accordance with predetermined game rules prior to resolving the player's hand, wherein if the dealer is still in the game after resolving the dealer's hand, the resolving structure further resolving the player's hand in accordance with the predetermined game rules.

According to still another aspect of the invention, there is provided an apparatus configured for playing a card game comprising a display, a player interface for receiving player input and a processor configured to effect game play.

BRIEF DESCRIPTION OF THE DRAWINGS

These and other aspects and advantages according to the present invention will be described in detail with reference to the accompanying drawings, wherein.

DETAILED DESCRIPTION OF PREFERRED EMBODIMENTS

In the following detailed description, the method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

Figure 1:
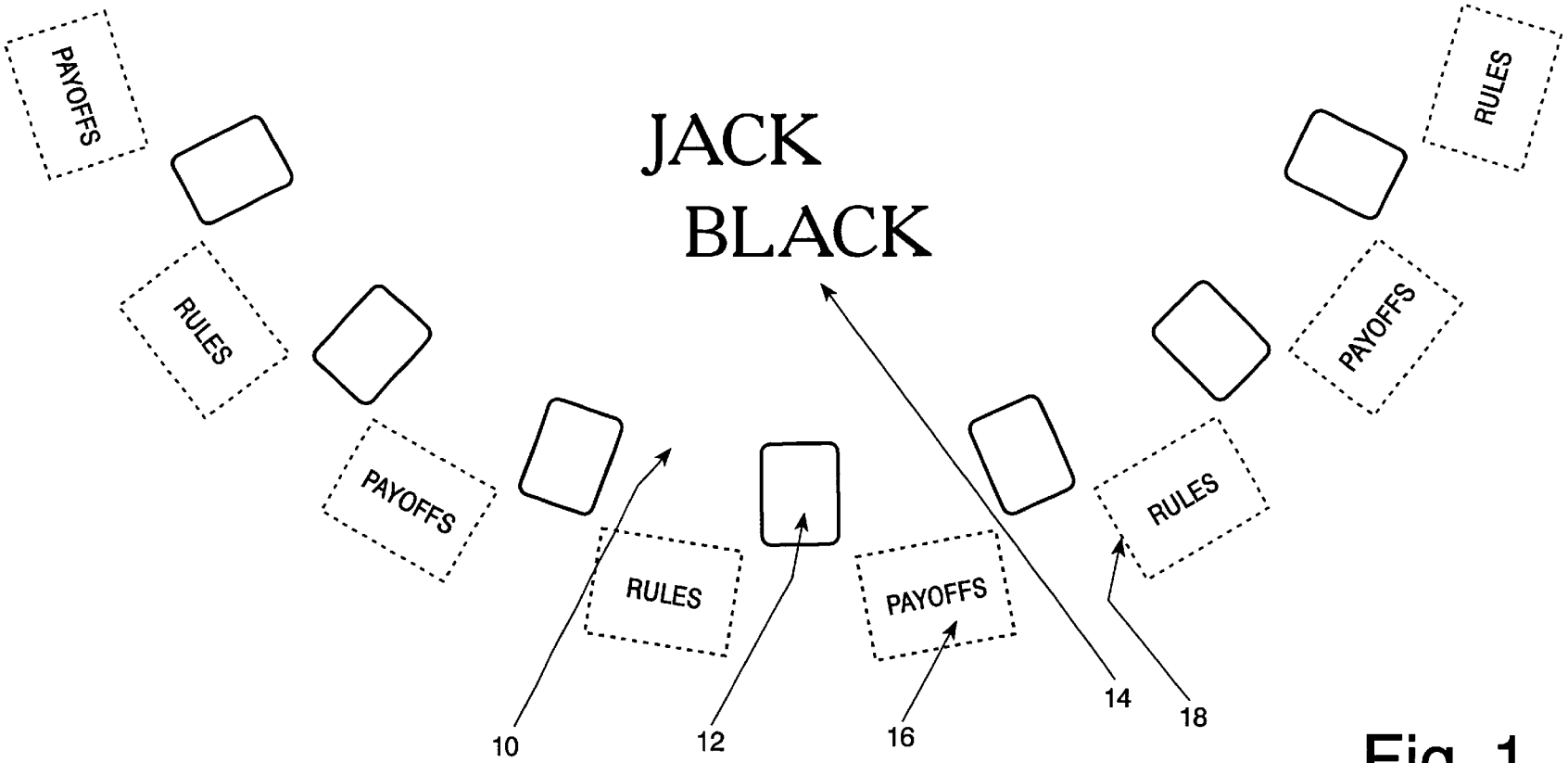
FIG. 1 is a plan view of a table arrangement according to the present invention.

In preferred forms, referring to FIG. 1, JackBlack™ is played on a Blackjack shaped table with dealer and cards similar to a conventional Blackjack game. The table is specifically marked with regular Blackjack bet areas with also payoff information and promotional material as in FIG. 1. FIG. 1 shows a playing surface or table layout 10 on which an embodiment of the invention may be played. The layout provides a betting area 12 for each of a plurality of players, for example, seven players. The dealer area 14 is marked with payoff scales 16 and game rules 18.

In the casino environment. the game proceeds as in regular Blackjack with each player first making a wager and receiving two cards while the dealer also receives two cards. Unlike regular Blackjack, both the dealer cards, rather than only one, are exposed and the dealer hand is completed first.

Card values correspond to values attributed to the cards in conventional Blackjack. That is, numbered cards 2–10 are valued at face value, face cards are valued at 10, and aces are valued at either 1 or 11, selectively according to game rules.

After the two-card hands are dealt to the players and the dealer, a numerical total of the dealer's hand is determined by adding the values of the cards in the dealer hand. If the numerical total of the dealer's hand is below a lower limit, such as 16 or 17, an additional card is dealt to the dealer and the numerical total of the dealer's hand is redetermined. The dealer continues to draw additional cards until the numerical total of the dealer's hand is equal to or greater than the lower limit. If the numerical total of the dealer's hand is equal to or greater than the lower limit without exceeding an upper limit, such as 21, the dealer is then in the game, and processing of player hands is commenced. Finally, if the numerical total of the dealer's hand exceeds the upper limit, the dealer busts and is out of the game. In the casino environment, when the dealer busts, every player receives a push (the wager is neither paid nor taken), all cards are collected, and the game proceeds to the next round.

When the dealer's hand is resolved and the dealer is in the game such that the numerical total of the dealer's hand is equal to or greater than the lower limit without exceeding an upper limit. e.g., between 17–21 inclusive, the numerical total of the player's hand is determined. Since the players witness the resolution of the dealer hand, if the numerical total of the player's hand is below the numerical total of the dealer's hand. an additional card is dealt to the player and the numerical total of the player's hand is redetermined. If the numerical total of the player's hand is equal to the numerical total of the dealer's hand, the game outcome is declared in accordance with predetermined rules of the game. In this context, the game is preferably declared a draw, and any wagers are pushed. House rules, however, may declare the house (i.e., the dealer) the winner in the event that the totals of the hands are equal or alternatively may declare the player as the winner. If the numerical total of the player's hand is above the numerical total of the dealer's hand without exceeding the upper limit, the player wins the game, and a payout based on the wager is paid to the player. Finally, if the numerical total of the player's hand exceeds the upper limit, the dealer wins the game, and any wager is taken by the dealer. All cards are then collected, and the game proceeds to a next round.

As mentioned, because the players have seen the complete resolution of the dealer hand, strategic decisions concerning when to take another card have been eliminated. Moreover, a major contributory factor to the house advantage at conventional Blackjack is the possibility of the player busting before the dealer, and the player loses. This factor has been removed in JackBlack™ as the dealer busts first. Moreover, in conventional Blackjack, the player may stand on a total below 17 for fear of busting. This circumstance has also been removed in JackBlack™ as the dealer hand has been exposed, and therefore the player draws and either ties, wins or busts. Removal of these house advantages is recompensed by pushing player wagers when the dealer busts, rather than players winning, as is the case in conventional Blackjack.

The game can be played using a single deck or multiple decks, and the house advantage varies slightly depending on the number of decks utilized. Conventional player options for splitting hands and/or doubling wagers can be offered or omitted, depending on the exact house advantage requirement. Moreover, bonus payoffs such as 3 to 2 for a natural player Blackjack (i.e., ace and a 10-value card) could also be added or removed, depending upon the desired house advantage. A 3 to 2 payoff for a natural 21 could apply either always or only when the dealer plays. Those familiar with the art will realize that there are a variety of minor rule adjustments that can be made to achieve a desired house advantage.

In a preferred embodiment. in the event that the dealer busts and thus the player hands are not played and wagers are pushed, all cards of the dealer's hand and the players' hands are collected, and new hands are dealt for the next round. In an alternative, the players' hands may be dealt face down and retained in the event that the dealer's hand is busted. In this case, only the dealer would receive a new hand, thereby increasing the speed of play and increasing the enjoyment of the game. In yet another alternative. a single player hand may be dealt, wherein each player playing the game would share the single player hand. This alternative would similarly increase the speed of play.

In a casino environment. in order to compensate for an increased house advantage, payouts to a winning player may correspond to a predetermined payoff scale in accordance with the player's hand. For example, if a two-card total of the player's hand is 21, i.e., a natural Blackjack, the dealer may pay the player based on the wager above 1 to 1, such as 3 to 2. For a natural Blackjack, for example, the player may win the payout amount regardless of the numerical total of the dealer's hand. That is, even if the dealer's hand totals 21 with two or more cards, a natural two-card 21 is determined to be the winner.

In the casino environment, the advantages according to the present invention can be achieved by resolving the dealer's hand in accordance with predetermined game rules prior to resolving the player's hand. Then, if the dealer is still in the game after resolving the dealer's hand, the player's hand can be resolved in accordance with the predetermined game rules. With this "reverse" play procedure, many disadvantages associated with conventional game play can be eliminated.

As would be apparent to those skilled in the relevant art, the invention can be embodied in a wide variety and forms of media, but not limited to, single player slot video machines, multi-player slot video machines, electronic games and devices, lottery terminals. scratch-card formats, software as well as in-flight, home and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
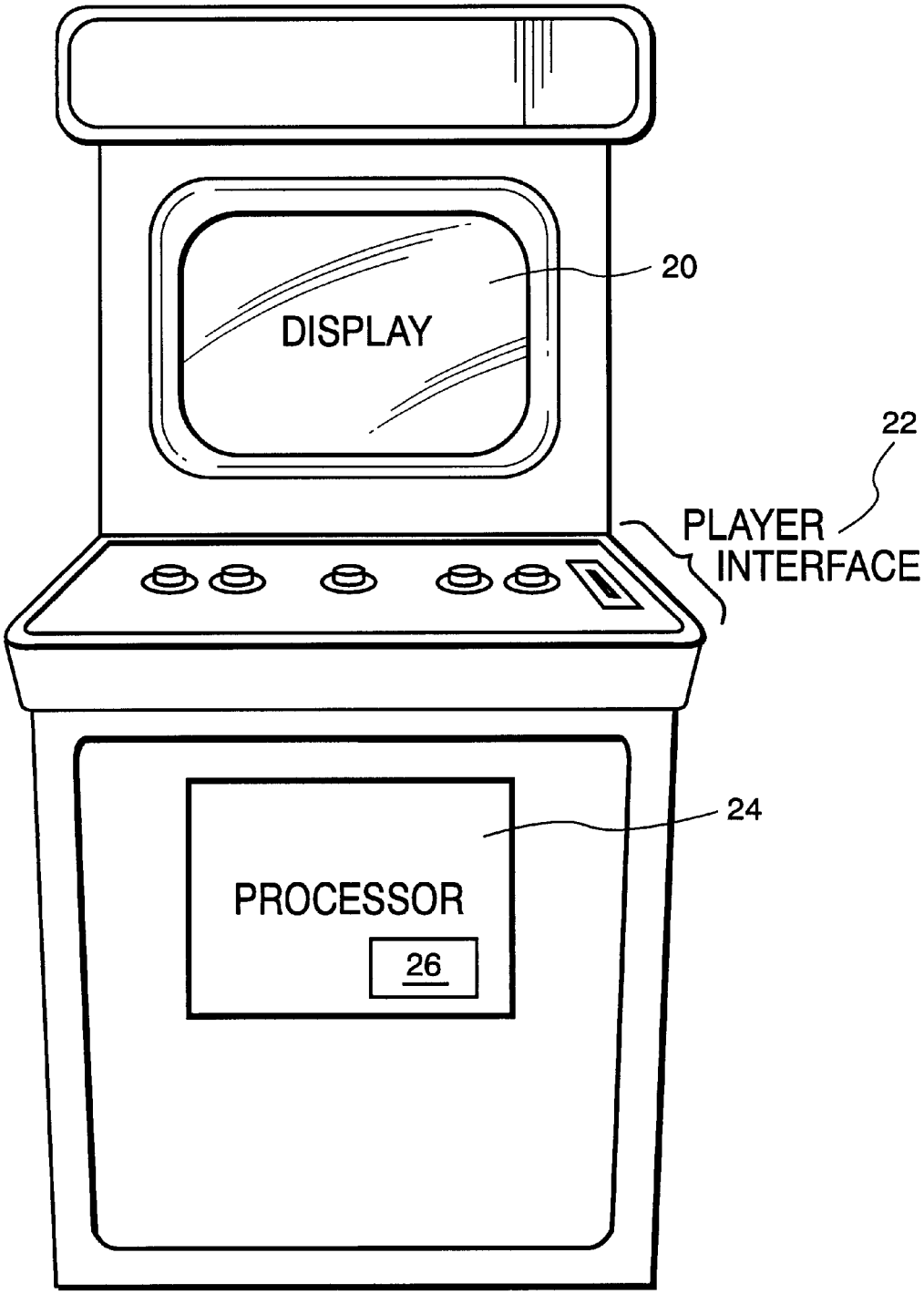
FIG. 2 is a block diagram illustrating the structure effecting game play according to the apparatus of the present invention.

In this context, referring to FIG. 2, a block diagram is illustrated showing the components of an apparatus configured for playing the card game according to the invention. The apparatus includes a display 20, a player interface 22, and circuitry 24, 26 for effecting game play and including structure for dealing hands of cards to a player and to a dealer, a summing circuit 26 that determines a numerical total of the dealer's hand, and a processing circuit 24 effecting game play based on the numerical total of the dealer's hand. The processing circuit effects game play in accordance with the rules of the game. The summing circuit 26, in the event that the dealer is still in the game after resolving the dealer's hand, determines a numerical total of the player's hand, and the processing circuit 24 then effects game play based on the numerical total of the player's hand in accordance with the rules of the game.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a card game comprising:

(a) dealing hands of cards to a player and to a dealer;

(b) determining a numerical total of the dealer's hand, wherein:

(b1) if the numerical total of the dealer's hand is below a lower limit, dealing an additional card to the dealer and repeating step (b), (b2) if the numerical total of the dealer's hand is equal to or greater than the lower limit without exceeding an upper limit, proceeding to step (c), and (b3) if the numerical total of the dealer's hand exceeds the upper limit, discarding the dealer's hand and skipping steps (c) and (c1)–(c4); and (c) determining a numerical total of the player's hand, wherein:

(c1) if the numerical total of the player's hand is below the numerical total of the dealer's hand. dealing an additional card to the player and repeating step (c), (c2) if the numerical total of the player's hand is equal to the numerical total of the dealer's hand, declaring the game outcome in accordance with predetermined rules of the game, (c3) if the numerical total of the player's hand is above the numerical total of the dealer's hand without exceeding the upper limit, the player winning the game, and (c4) if the numerical total of the player's hand exceeds the upper limit, the dealer winning the game.

2. A method according to claim 1, wherein steps (b) and (c) are practiced in accordance with Blackjack card values.

3. A method according to claim 1, wherein step (a) is practiced by dealing two-card hands to the player and to the dealer.

4. A method according to claim 1, wherein the upper limit is 21.

5. A method according to claim 4, wherein the lower limit is 16.

6. A method according to claim 4, wherein the lower limit is 17.

7. A method according to claim 1, wherein if the numerical total of the dealer's hand exceeds the upper limit, after discarding the dealer's hand and skipping steps (c) and (c1)–(c4) in step (b3), discarding the player's hand and repeating step (a).

8. A method according to claim 1, wherein if the numerical total of the dealer's hand exceeds the upper limit, after discarding the dealer's hand and skipping steps (c) and (c1)–(c4) in step (b3), dealing a new hand of cards to the dealer.

9. A method according to claim 1, wherein step (a) is practiced by alternately dealing cards to the player and the dealer in rotation.

10. A method according to claim 1, wherein if the numerical total of the player's hand is equal to the numerical total of the dealer's hand, step (c2) is practiced by declaring the game a draw.

11. A method according to claim 1, wherein if the numerical total of the player's hand is equal to the numerical total of the dealer's hand, step (c2) is practiced by declaring the dealer as the winner.

12. A method according to claim 1, wherein if the numerical total of the player's hand is equal to the numerical total of the dealer's hand, step (c2) is practiced by declaring the player as the winner.

13. A method according to claim 1, further comprising, prior to step (a), the step of receiving a wager from the player, wherein if the player wins the game, the dealer paying the player an amount based on the wager, and wherein if the dealer wins the game, the player forfeiting the wager.

14. A method according to claim 13, wherein prior to step (c) or subsequent to step (c1), the player has an option of doubling the wager.

15. A method according to claim 13, wherein if the player wins the game, the amount paid to the player corresponds to a predetermined payoff scale in accordance with the player's hand.

16. A method according to claim 13, wherein if a two-card total of the player's hand is 21, the dealer paying the player an amount based on the wager above one to one.

17. A method according to claim 16, wherein if the two-card total of the player's hand is 21, the dealer paying the amount regardless of the numerical total of the dealer's hand.

18. A method according to claim 1, wherein prior to step (c) or subsequent to step (c1), the player has an option of splitting pairs.

19. A method according to claim 1, wherein a two-card numerical total of 21 is equivalent to a three or more-card total of 21.

20. A method according to claim 1, wherein step (a) is practiced by dealing hands of cards to a plurality of players, and wherein each of the plurality of players play the game against the dealer.

21. A method according to claim 1, wherein the player's hand is shared by a plurality of players.

22. A method of playing a card game comprising:

(a) dealing hands of cards to a player and to a dealer, at least the dealer hand being dealt face up;

(b) resolving the dealer's hand in accordance with predetermined game rules prior to resolving the player's hand; and (c) if the dealer is still in the game after step (b), resolving the player's hand based on the resolved dealer's hand in accordance with the predetermined game rules.

23. A method according to claim 22, wherein step (b) is practiced by (d) determining a numerical total of the dealer's hand, and wherein the predetermined game rules comprise:

(d1) if the numerical total of the dealer's hand is below a lower limit, dealing an additional card to the dealer and repeating step (d), (d2) if the numerical total of the dealer's hand is equal to or greater than the lower limit without exceeding an upper limit, proceeding to step (c), and (d3) if the numerical total of the dealer's hand exceeds the upper limit, discarding the dealer's hand.

24. A method according to claim 23, wherein step (c) is practiced by (e) determining a numerical total of the player's hand, and wherein the predetermined game rules further comprise:

(e1) if the numerical total of the player's hand is below the numerical total of the dealer's hand, dealing an additional card to the player and repeating step (e), (e2) if the numerical total of the player's hand is equal to the numerical total of the dealer's hand, declaring the game outcome in accordance with the predetermined game rules, (e3) if the numerical total of the player's hand is above the numerical total of the dealer's hand without exceeding the upper limit, the player winning the game, and (e4) if the numerical total of the player's hand exceeds the upper limit, the dealer winning the game.

25. A method according to claim 24, wherein steps (d) and (e) are practiced in accordance with Blackjack card values.

26. A method according to claim 24, wherein the upper limit is 21.

27. A method according to claim 24, wherein the lower limit is 16.

28. A method according to claim 24, wherein the lower limit is 17.

29. A method according to claim 24, further comprising, prior to step (a), the step of receiving a wager from the player, wherein if the player wins the game, the dealer paying the player an amount based on the wager, and wherein if the dealer wins the game, the player forfeiting the wager.

30. A method according to claim 29, wherein prior to step (e) or subsequent to step (e1), the player has an option of doubling the wager.

31. A method according to claim 29, wherein if the player wins the game, the amount paid to the player corresponds to a predetermined payoff scale in accordance with the player's hand.

32. A method according to claim 29, wherein if a two-card total of the player's hand is 21, the dealer paying the player an amount based on the wager above one to one.

33. A method according to claim 32, wherein if the two-card total of the player's hand is 21, the dealer paying the amount regardless of the numerical total of the dealer's hand.

34. A method according to claim 24, wherein prior to step (e) or subsequent to step (e1), the player has an option of splitting pairs.

35. A method according to claim 23, wherein if the numerical total of the dealer's hand exceeds the upper limit, after discarding the dealer's hand, discarding the player's hand and repeating step (a).

36. A method according to claim 23, wherein if the numerical total of the dealer's hand exceeds the upper limit, after discarding the dealer's hand, dealing a new hand of cards to the dealer.

37. A method according to claim 22, wherein step (a) is practiced by alternately dealing cards to the player and the dealer in rotation.

38. A method according to claim 22, wherein step (a) is practiced by dealing hands of cards to a plurality of players, and wherein each of the plurality of players play the game against the dealer.

39. A method according to claim 22, wherein the player's hand is shared by a plurality of players.

40. A method according to claim 22, wherein step (a) is practiced by dealing two-card hands to the player and to the dealer.

41. An apparatus configured for playing a card game comprising:

means for dealing hands of cards to a player and to a dealer, at least the dealer hand being dealt face up; and means for resolving the dealer's hand in accordance with predetermined game rules prior to resolving the player's hand, wherein if the dealer is still in the game after resolving the dealer's hand, the resolving means further resolving the player's hand based on the resolved dealer's hand in accordance with the predetermined game rules.

* * * * *